US006371067B1

(12) United States Patent
Schmitz et al.

(10) Patent No.: US 6,371,067 B1
(45) Date of Patent: Apr. 16, 2002

(54) CAPACITOR ASSISTED STARTER CIRCUIT

(75) Inventors: John J. Schmitz; A. David Stormer; Kenneth J. Libby, all of Macomb County, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/696,701

(22) Filed: Oct. 26, 2000

(51) Int. Cl.[7] ..... F02N 11/08

(52) U.S. Cl. ..... 123/179.3; 123/179.28; 290/38 R; 290/50; 320/166

(58) Field of Search ..... 123/179.1, 179.3, 123/179.28; 290/38 R, 50; 307/10.6; 320/104, 166, 167

(56) References Cited

U.S. PATENT DOCUMENTS 6,057,666 A * 5/2000 Dougherty et al. ..... 320/104

6,242,887 B1 * 6/2001 Burke ..... 320/104

* cited by examiner

*Primary Examiner*—Andrew M. Dolinar

(74) *Attorney, Agent, or Firm*—David L. Kuhn; Clifford C. Carter; Gail S. Soderling

(57) ABSTRACT

A starter circuit provides capacitor-assisted energization of a vehicle's starter motor and prevents damage to capacitors in the circuit. The circuit includes a battery, a capacitor pack and a power control switch in the line connecting the pack to the motor and battery. The starter circuit includes a regulator for limiting current flow from the battery to the pack to a selected rate, the regulator being connected between the battery and the pack in parallel with the power control switch. A regulator switch is between the regulator and the capacitor pack. The starter circuit has a control circuit for selectively opening and closing the switches in response to a voltage level of the pack. The control circuit detects the voltage level of the pack, opens the power control switch when the voltage level falls below a predetermined threshold and simultaneously closes the regulator switch. The control circuit thus protects capacitors in the pack from a sudden, potentially damaging surge of current from the battery and permits a relatively gradual charging of the capacitors.

5 Claims, 1 Drawing Sheet

CAPACITOR ASSISTED STARTER CIRCUIT

GOVERNMENT USE

The invention described here may be made, used and licensed by the or for the U.S. Government for governmental purposes without paying us any royalty.

BACKGROUND AND SUMMARY

In recent years there has been an increased use of capacitors in the electrical systems of vehicles to meet surges in power demand. One particular use of capacitors is to augment the vehicle battery's power when starting the vehicle. Since capacitors are charged gradually over time by such means as solar cells, repeated discharges of the capacitors in a brief period will drain them. Another problem occurs if the solar cells malfunction or are exposed to insufficient sunlight for long periods because the capacitors' charge will ebb over time and the capacitors will be ineffective when needed for a power assist.

We solve the foregoing problems with a capacitor-assisted starter circuit wherein a pack of capacitors is recharged under controlled conditions by the battery as the vehicle runs. The starter circuit includes a control circuit which prevents spikes of charge to the capacitors when the pack's voltage has fallen below a safe threshold. The control circuit thus prevents damage to the capacitors that the spike can cause and allows the battery to function more efficiently when charging the capacitor pack.

DETAILED DESCRIPTION

Figure 1:
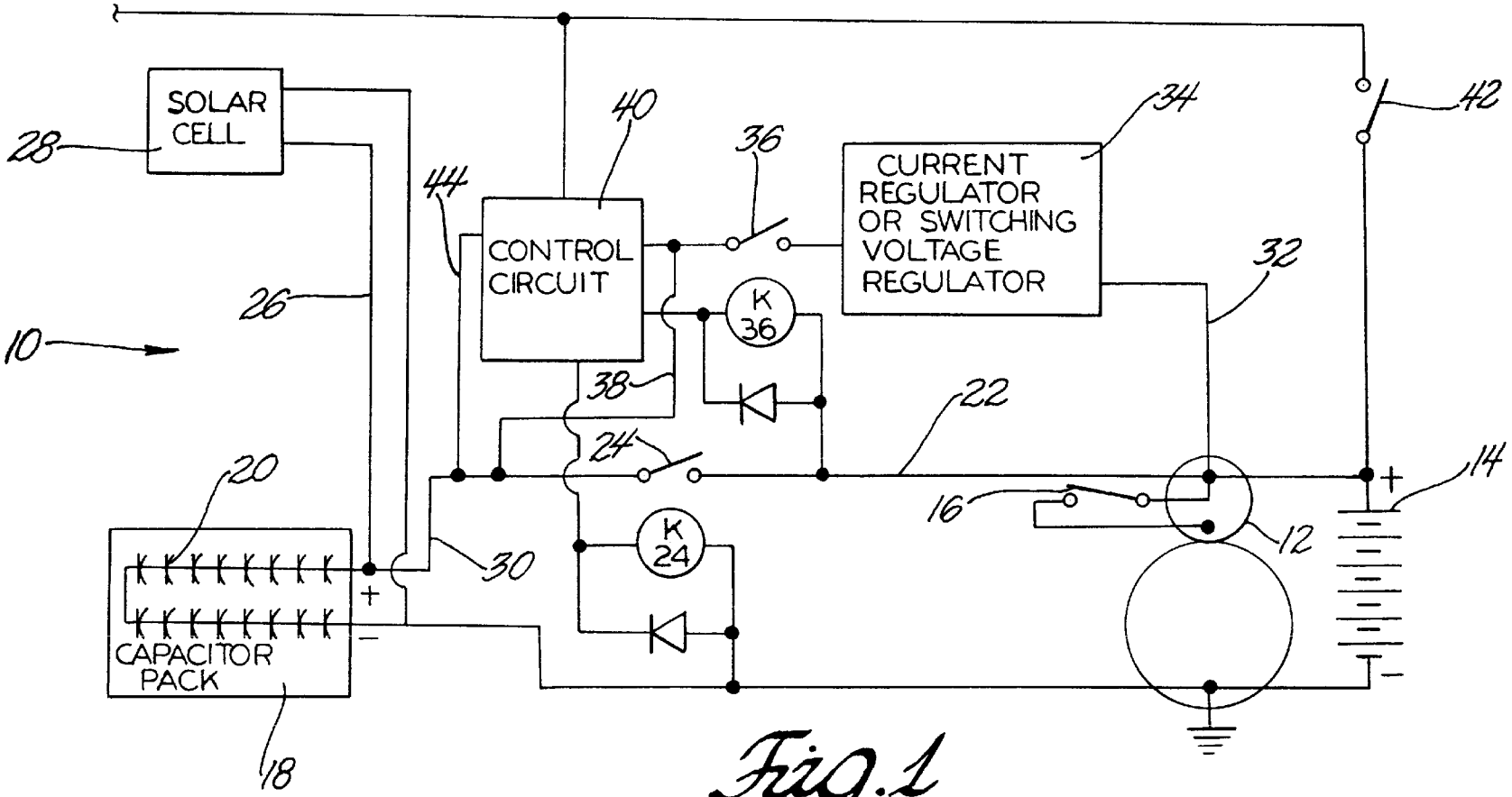
FIG. 1 is a schematic diagram of our capacitor assisted starter circuit.

FIG. 1 shows a vehicle engine starter circuit 10 having a starter motor 12 connected to battery 14 through a starter-motor switch 16. Circuit 10 also includes a capacitor pack 18 for assisting the battery to energize starter motor 12, the pack comprised of individual capacitors, as at 20. For a typical circuit having a 24-volt battery, capacitor pack 18 will have 14 to 16 capacitors in series rated at 2.3 volts each and the pack is gradually charged through line 26 from a solar cell 28. Capacitor pack 18 is connected to starter motor 12 and battery 14 via two paths, the first of which is through line segment 22, a connector switch 24 and line segment 30. If switch 24 is closed, pack 18 helps battery 14 to energize starter motor 12 during closure of switch 16. The second path connecting pack 18 to starter motor 12 and battery 14 is through line 32 to a current regulator or switching voltage regulator 34, thence through switch 36, line segment 38 and line segment 30. Switch 36 is normally open, even when starter motor switch 16 is closed, so that normally current from battery 14 does not flow through regulator 34 to pack 18.

Starter circuit 10 is governed by a control circuit 40, which is activated when vehicle ignition switch 42 closes. Circuit 40 responds to the voltage level of pack 1.8, as received through line segment 44, to selectively actuate relays K24 and K36, which in turn operate complimentary switches 24 and 36. These latter two switches are open when switch 42 is open and circuit 40 is deactivated. Once activated, circuit 40 will close switch 24 only if the voltage of pack 18 exceeds a predetermined threshold, typically one-half the voltage of the battery.

Occasionally, capacitor pack will become low on charge and fall below the threshold if, for example, solar cell malfunctions or starter motor 12 is energized repeatedly within a short period of time. In such an event, it is desirable to prevent battery 14 from supplying current directly to pack 18 over line 22 since the direct energizing would be a relatively sudden influx of charge to pack 18, which could damage the capacitors. Also, repeated instances of direct charging can damage battery 14. Additionally, the internal resistance of the battery 14 makes it less efficient when sending pack 18 a relatively large amount of energy in a short period of time. Consequently, circuit 40 will leave switch 24 open if pack 18 is below the predetermined voltage. While switch 24 is open and switch 16 is closed, battery 14 alone energizes motor 12.

When control circuit leaves open switch 24, it closes switch 36, so that current can flow from battery to pack 18 through regulator 34. The current flowing to pack 12 is slowed sufficiently to avoid damage to pack 12 and reduce energy loss due to the internal resistance of battery 14. When the voltage of pack 18 reaches the aforementioned threshold or a higher selected threshold if desired, circuit 40 closes switch 24 and opens switch 36. Then both battery 14 and pack 18 energize starter motor 12 if switch 16 is closed.

We wish it to be understood that we do not desire to be limited to the exact details of construction or method shown herein since obvious modifications will occur to those skilled in the relevant arts without departing from the spirit and scope of the following claims.

We claim:

1. In a vehicle having an engine actuated by a starter motor, a circuit for providing capacitor-assisted electrical energization of the starter motor, comprising:

the starter motor;

a battery communicated to the starter motor;

a capacitor pack comprised of a multiplicity of capacitors; the pack communicated to the battery and to the motor;

a power control switch connected in series between the pack and the motor;

regulator means for allowing current from the battery to flow to the pack at no more than a selected limited rate, the regulator means connected between the battery and the pack in parallel with the power control switch;

a regulator switch between the regulator means and the pack; and control means for selectively opening and closing the power control switch and the regulator switch in response to a predetermined voltage level of the pack.

2. The circuit of claim 1 wherein the control means comprises:

means to detect the voltage level of the pack;

means to open the power control switch when the voltage level falls below a predetermined threshold; and means to close the regulator switch when the voltage level falls below the predetermined threshold.

3. The circuit of claim 2 wherein the means to open the power control switch is also a means to close the power control switch when the voltage level of the pack exceeds the predetermined threshold.

4. The circuit of claim 2 wherein the means to open the power control switch is also a means to close the power control switch when the voltage level of the pack exceeds the a selected threshold higher than the predetermined threshold.

5. The circuit of claim 2 further including means for activating and deactivating the control means comprising an ignition switch between the battery and the control means, wherein deactivation of the control means opens the power control switch and the regulator switch.

* * * * *